US009916953B2

(12) United States Patent
Weichert et al.

(10) Patent No.: US 9,916,953 B2
(45) Date of Patent: Mar. 13, 2018

(54) CLAPPER ARMATURE WITH CURVED POLE FACE

(71) Applicant: Rockwell Automation Switzerland GmbH, Aarau (CH)

(72) Inventors: Hans Weichert, Granichen (CH); Pascal Benz, Aarau (CH)

(73) Assignee: Rockwell Automation Switzerland GmbH (CH)

( * ) Notice: Subject to any disclaimer, the term of this patent is extended or adjusted under 35 U.S.C. 154(b) by 0 days.

(21) Appl. No.: 14/971,580

(22) Filed: Dec. 16, 2015

(65) Prior Publication Data

US 2017/0178849 A1 Jun. 22, 2017

(51) Int. Cl.

| | |
|---|---|
| ***H01H 50/24*** | (2006.01) |
| ***H01H 50/36*** | (2006.01) |
| ***H01H 50/64*** | (2006.01) |
| ***H01H 51/22*** | (2006.01) |
| ***H01H 50/26*** | (2006.01) |
| ***H01H 50/56*** | (2006.01) |
| ***H01H 50/58*** | (2006.01) |

(52) U.S. Cl.

CPC ..... *H01H 50/24* (2013.01); *H01H 50/26* (2013.01); *H01H 50/36* (2013.01); *H01H 50/56* (2013.01); *H01H 50/58* (2013.01); *H01H 50/643* (2013.01); *H01H 51/2272* (2013.01)

(58) Field of Classification Search

CPC ..... H01H 50/24–50/28; H01H 50/56; H01H 50/58; H01H 50/643; H01H 50/644; H01H 51/2272–51/229

USPC ..... 335/78–86, 275–276

See application file for complete search history.

(56) References Cited

U.S. PATENT DOCUMENTS

| | | | | |
|---|---|---|---|---|
| 3,477,049 | A * | 11/1969 | Kreidler | G04C 1/022 335/276 |
| 4,045,755 | A | 8/1977 | Schroeder et al. | |
| 5,646,588 | A | 7/1997 | Cannon | |
| 6,798,322 | B2 * | 9/2004 | Copper | H01H 50/305 335/128 |
| 7,053,742 | B2 | 5/2006 | Lannei et al. | |
| 8,502,627 | B1 | 8/2013 | Ahmad et al. | |
| 8,896,402 | B2 | 11/2014 | Soukup | |

FOREIGN PATENT DOCUMENTS

| | | |
|---|---|---|
| DE | 3823851 A1 | 2/1989 |

* cited by examiner

*Primary Examiner* — Ramon M Barrera
(74) *Attorney, Agent, or Firm* — Timothy P. Boppre

(57) ABSTRACT

The present disclosure describes an apparatus for increasing the initial closing force and reducing the final closing force in the actuating mechanism of electromechanical switching devices such as relays or contactors.

16 Claims, 9 Drawing Sheets

CLAPPER ARMATURE WITH CURVED POLE FACE

BACKGROUND

The invention relates generally to electromechanical switching devices such as relays or contactors. More particularly the invention relates to the armature or stator that is a part of the actuating mechanism.

Among the various mechanisms used to mechanically actuate electromechanical switching devices such as relays or contactors a commonly used form is the clapper mechanism. The clapper mechanism is named as it functions in a manner similar to that of clapping hands. One hand is movable and is called the armature. The armature is drawn by magnetic force to the second hand which is stationary and is referred to as the stator or core. An electromagnetic field is induced into the stator through the use of a coil that can be excited by either direct current (DC) or alternating current (AC). Application of a voltage to the coil will result in an electromagnetic field being induced in the stator which will attract the armature as the armature is comprised of a ferromagnetic material. As the armature is attracted to the stator it moves to the closed state for the device and actuates a mechanism which opens and closes electrical contacts in the electromechanical switching device. Removal of the voltage to the coil results in the loss of the electromagnetic field of the stator and the armature will move away from the stator under the influence of a return mechanism, usually comprised of a spring or other tension providing device, until it comes to rest in what is known as the open state. It is important to note that for the purposes of this disclosure the words "open" and "closed" refer to the state of the actuating mechanism for the device. Open being when the coil is de-energized and closed being when the coil is energized. Another usage for the terms "open" and "closed" is in relation to the electrical contacts that are operated by the clapper mechanism where the electrical contacts being controlled are commonly referred to as either Normally Open (NO) or Normally Closed (NC). For the purposes of this disclosure "open" and "closed" will refer to the state of the clapper mechanism, not the electrical contacts that may be controlled by the device.

Clapper mechanisms are designed with planar armature plates and planar stator cores that move about a fixed fulcrum point on the bottom of the armature plate. Upon energizing the coil, an electromagnetic field is created in the stator, and the armature is attracted to the stator and moves toward it until it comes to rest upon contacting the face of the stator. The armature is held in this position by electromagnetic force until such time when the coil is de-energized at which point the electromagnetic field collapses and the armature returns to the open state under the influence of the return mechanism.

In the art, the voltage at which the coil is energized is referred to as the "pull-in" voltage and the voltage at which the coil is de-energized is referred to as the "drop-out" voltage. Recall that the coil voltage induces an electromagnetic field in the coil and in turn the stator, thus below the pull-in voltage the electromagnetic field is insufficient to overcome the mass, friction, and return mechanism of the armature and move it into the closed position. At or above the pull-in voltage there will be sufficient electromagnetic field to overcome these elements and the clapper armature will be moved to the closed state. Conversely, in order to return the clapper mechanism to the open state the electromagnetic field must decrease to a point at which it can be overcome by the return mechanism and thus move the armature away from the stator pole face to the open position.

In the open position the planar armature is positioned with an inclination of a few degrees in relation to the flat pole face of the stator or core. This relationship describes a triangular shaped volume of air and defines the amount of travel required to close the clapper mechanism. Due to the size of the volume of air in the case where both the armature and stator have a planar face, the pull-in voltage must be high enough to generate an electromagnetic field sufficient to initiate the closing of the mechanism. The magnetic field starts out relatively weak though sufficient to initiate movement so the initial closing force is relatively low. However, as the armature moves toward the flat pole face of the stator the magnetic field rapidly increases and in turn the closing force until the armature contacts the pole face of the stator in the closed position. A problem with typical planar faced armature and stator embodiments is that this rapid increase of closing force overshoots the level required to close the clapper mechanism resulting in undesired wear and a decrease in the mechanical life of the device.

When the clapper mechanism is closed the magnetic field is at its strongest. Unfortunately the strength of the magnetic field in the closed state requires the drop-out voltage of the coil to fall to a very low level in order to allow the return mechanism to overcome the electromagnetic field and move the armature to the open state. The longer it takes for the coil to become de-energized the longer an electrical circuit that is being controlled by the contacts associated with the electromechanical switching device remain energized consequently presenting a potentially hazardous state to people or devices in addition to decreasing the service life of the device due to longer arcing times until the clapper mechanism moves to the open state and in turn de-energizes any circuits associated with the electromechanical switching device.

Thus there remains a need to increase the drop-out voltage within the tolerance band given by the relevant product standards in order to increase the speed at which a controlled circuit is de-energized improving safety while simultaneously decreasing the pull-in voltage resulting in a longer service life for these devices.

BRIEF DESCRIPTION

The embodiments in the present disclosure provide a novel technique for increasing the force between the armature and the core of an electromechanical switching device resulting in the reduction of the required pull-in voltage. Additionally the remnant or holding force of the closed armature is reduced which results in increased dropout voltage allowing the electromechanical switching device to open more quickly when the control voltage has been removed.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
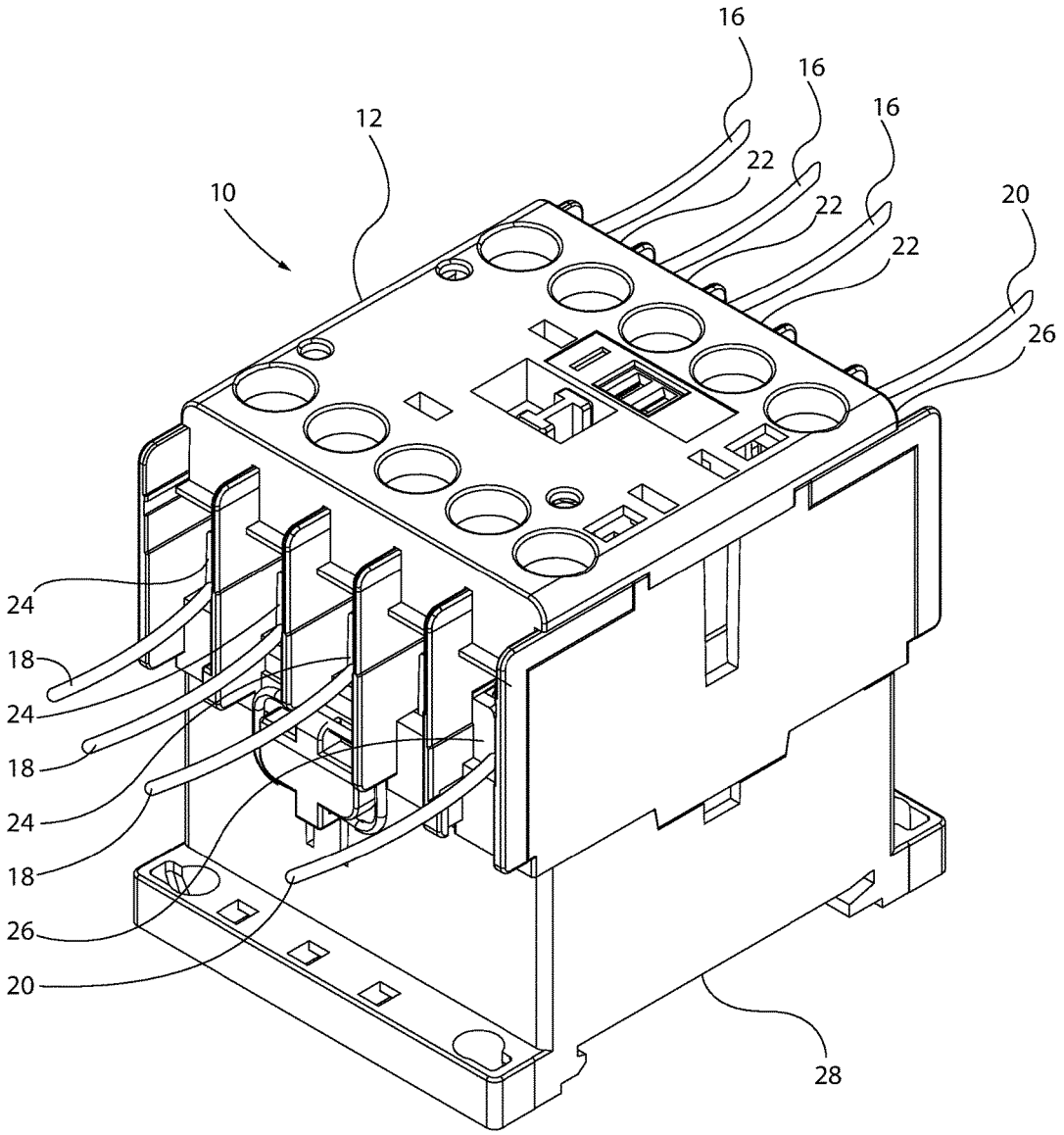
FIG. 1 is a perspective view of an electromechanical switching device, in this case a contactor.

Turning now to the drawings, and referring to FIG. 1, a circuit interrupting device is illustrated in the form of a three-pole contactor 10 for controlling electrical current carrying paths for three separate circuits. The contactor 10 includes an upper housing 12 and a lower housing 14. Upper housing 12 hosts one or more sets of electrically isolated contacts contained within the assembly. Line terminals 22 are used to connect line input wires 16 to each contact set. Load terminals 24 are used to connect contact outputs to the load output wires 18. Also included are coil terminals 26 for the connection of the wires 20 that provide the electrical connection for the application of the control voltage to the stator coil 32 illustrated in FIG. 2.

Figure 2:
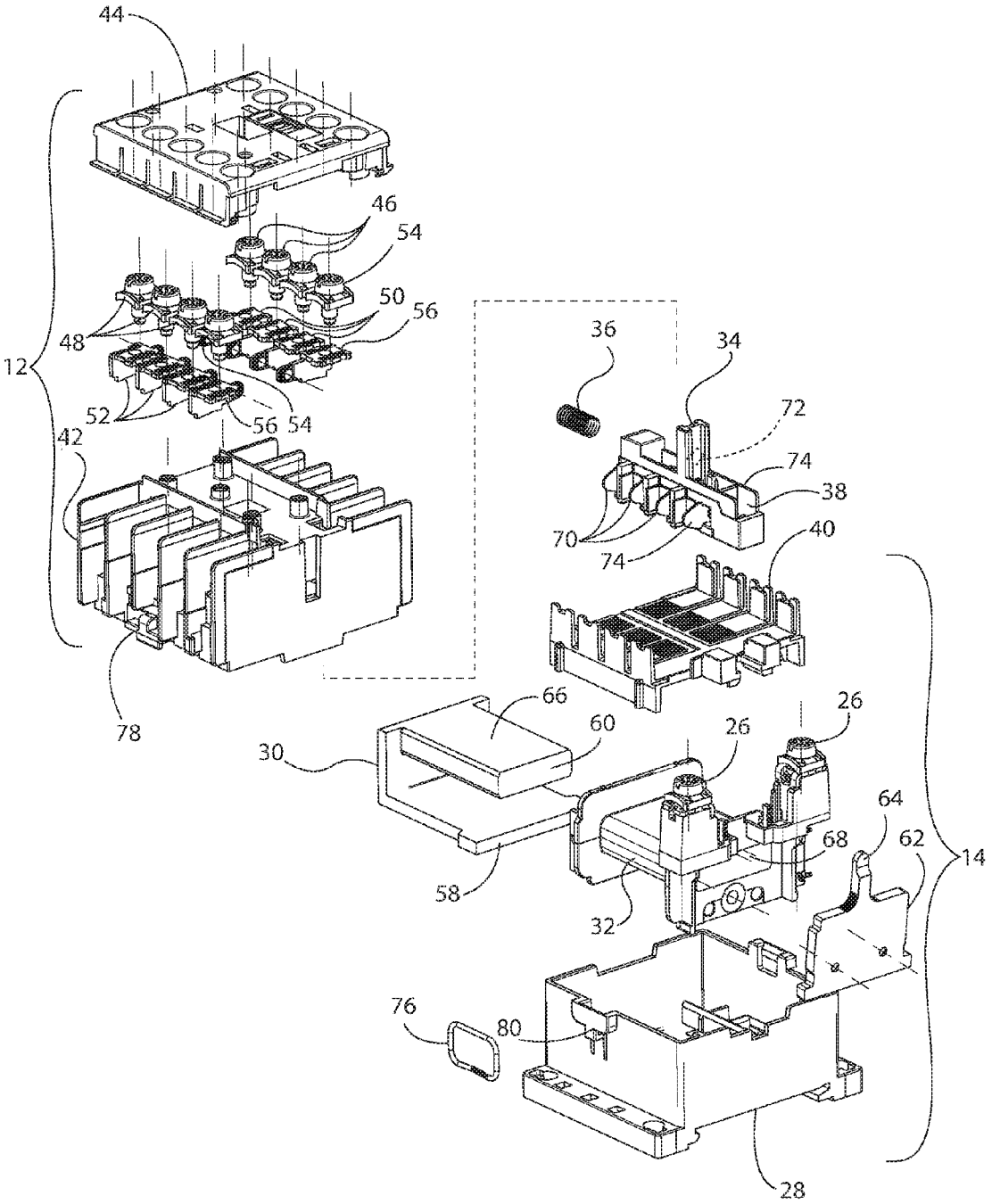
FIG. 2 is an exploded perspective drawing of the contactor of FIG. 1.

An exploded perspective view of the contactor 10 is provided in FIG. 2. Upper housing 12 comprises a cover 44, a set of line terminals with fixed contacts 50 and associated line terminal block screws 46, a set of load terminals with fixed contacts 52 and associated load terminal block screws 48, a set of auxiliary terminals and fixed contacts 56 and associated auxiliary terminal block screws 54 all of which are contained within the contact housing 42. Contact housing 42 provides electrical isolation between individual terminals and contacts. Crossbar assembly 34 is transversely oriented on an axis perpendicular to that of the axis formed by the line terminals with fixed contacts 50, the load terminals with fixed contacts 52, and the auxiliary terminals with fixed contacts 56 such that lateral movement of crossbar assembly 34 will complete electrical circuits by the movement of moveable line contacts 72, moveable load contacts, and moveable auxiliary contacts 74 into contact with their associated fixed contacts. Return spring 36 will return contact assembly 34 and associated moveable contacts to the open state in turn opening the associated electrical circuits.

Continuing in reference to FIG. 2, lower housing 14 comprises middle plate 40 which is positioned below contact housing 42 and crossbar assembly 34 and provides arc containment and electrical isolation to stator coil 32 and stator core 30. Stator core 30 is inserted into stator coil slot 68 of stator coil 32 and in turn lower housing 14. Armature 62 is positioned in lower housing 14 in free supported relation to the lower stator core face 58 and upper stator core face 60. Stator coil 32 comprises a set of electrical windings whose ends are connected to coil terminals 26 such that the connection of an electrical current to coil terminals 26 energizes stator coil 32 and causes the formation of an electromagnetic field which is concentrated by stator core 30. The electromagnetic attraction of the stator core 30 results in a rolling movement having a shifting center point of armature 62 towards stator core 30. Movement of armature 62 causes movement of crossbar assembly 34 by the engagement of crossbar engagement arm 64 with actuator slot 38 of crossbar assembly 34 completing electrical circuits by the movement of moveable line contacts 72, moveable load contacts 70, and moveable auxiliary contacts 74 into contact with their associated fixed contacts. The removal of electrical current from coil terminals 26 de-energizes stator coil 32 causing the collapse of the electromagnetic field in stator coil 32 and stator core 30 and with the loss of the electromagnetic field, the loss of the associated attraction of armature 62, and thus crossbar assembly 34 is returned to its de-energized state by return spring 36. Lower housing 14 has a generally rectangular base providing a slot 28 therein for receiving a standard DIN rail along the transverse axis generally within the plane of the base. Upon assembly, upper housing 12 and lower housing 14 and associated elements are fastened together by closure ring 76 which is positioned between upper catch 78 and lower catch 80.

Figure 3A:
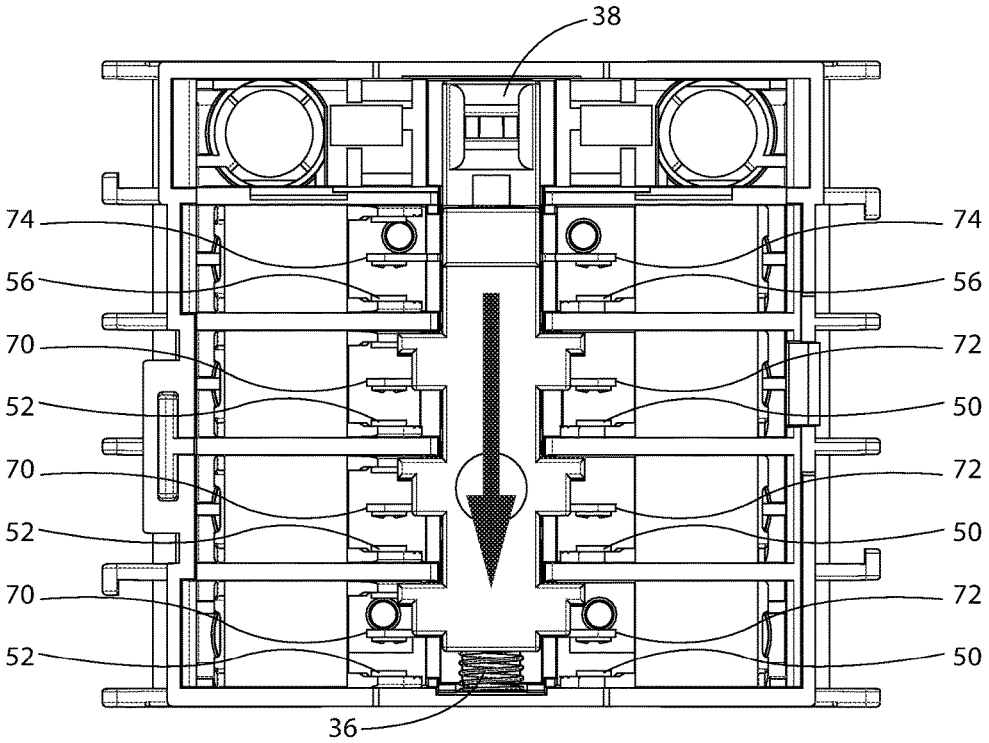
FIG. 3A is a bottom view of the upper housing of the contactor of FIG. 1 showing the contactor in a de-energized state.
Figure 3B:
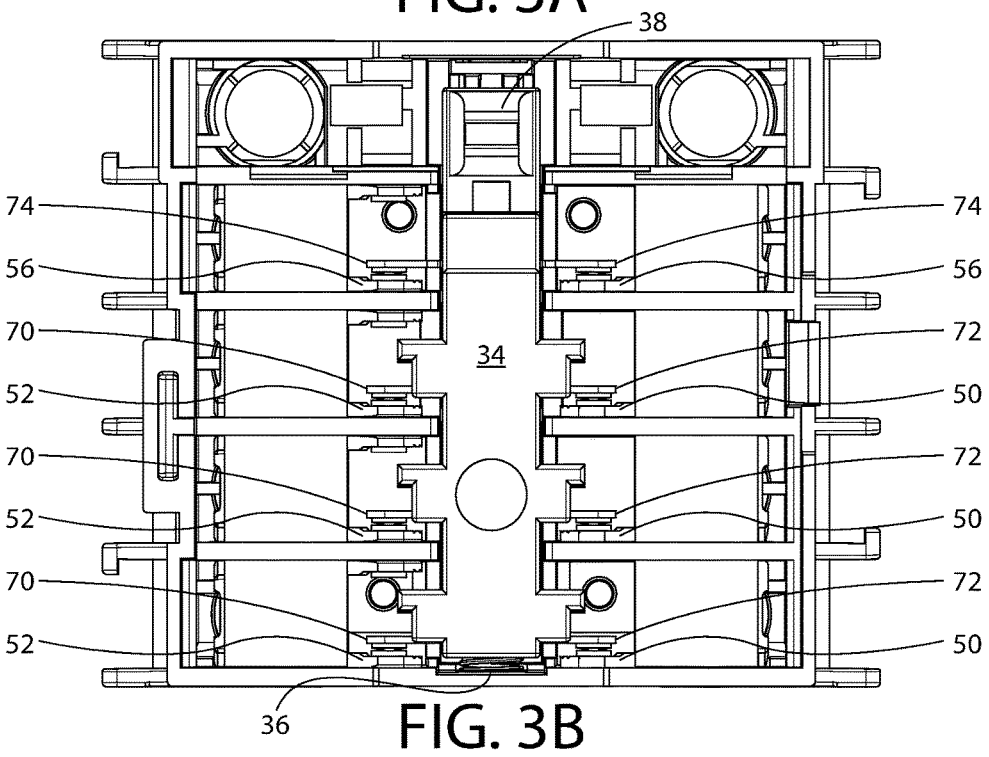
FIG. 3B is a bottom view of the upper housing of the contactor of FIG. 1 showing the contactor in an energized state.
Figure 4A:
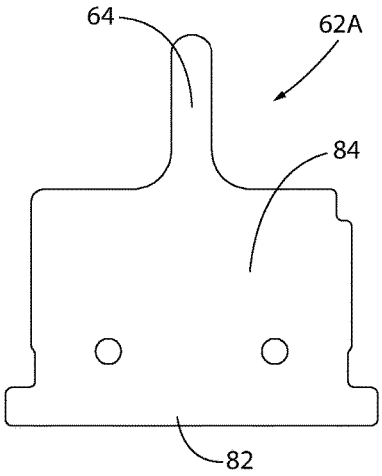
FIG. 4A is a front view of an armature with a radius embodiment of the pole face.
Figure 4B:
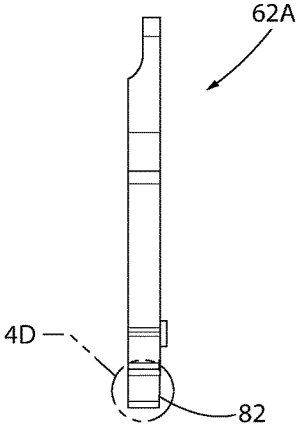
FIG. 4B is a side view of an armature with a radius embodiment of the pole face.
Figure 4C:
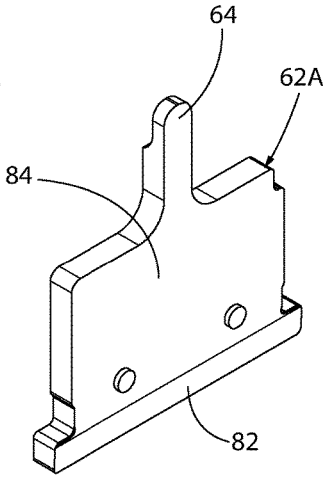
FIG. 4C is a perspective view of an armature with a radius embodiment of the pole face.
Figure 4D:
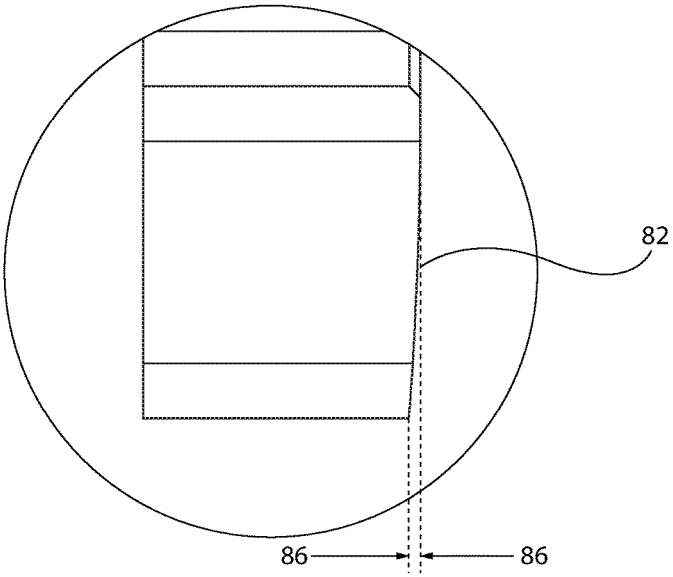
FIG. 4D is a detail view of the pole face of an armature with a radius embodiment of the pole face.

Turning to FIG. 3A and FIG. 3B, bottom views of the upper housing 12 of the contactor of FIG. 1 are shown depicting the contactor in a de-energized state in FIG. 3A and an energized state in FIG. 3B. As described in FIG. 2, energizing stator coil 32 and the associated electromagnetic field formed by stator core 30 results in the movement of armature 62 and crossbar engagement arm 64 which is engaged with actuator slot 38 of crossbar assembly 34 causing its subsequent motion and the completion of electrical circuits by the movement of moveable line contacts 72, moveable load contacts 70, and moveable auxiliary contacts 74 into contact with their associated fixed contacts, line terminal block and contact 50, load terminal block and contact 52, and auxiliary terminal block and contact 56. Upon removal of the electrical current from coil terminals 26 and the loss of the electromagnetic field of stator coil 32 and stator core 30, return spring 36 returns crossbar assembly 34 and armature 62 to a de-energized state.

Figure 5A:
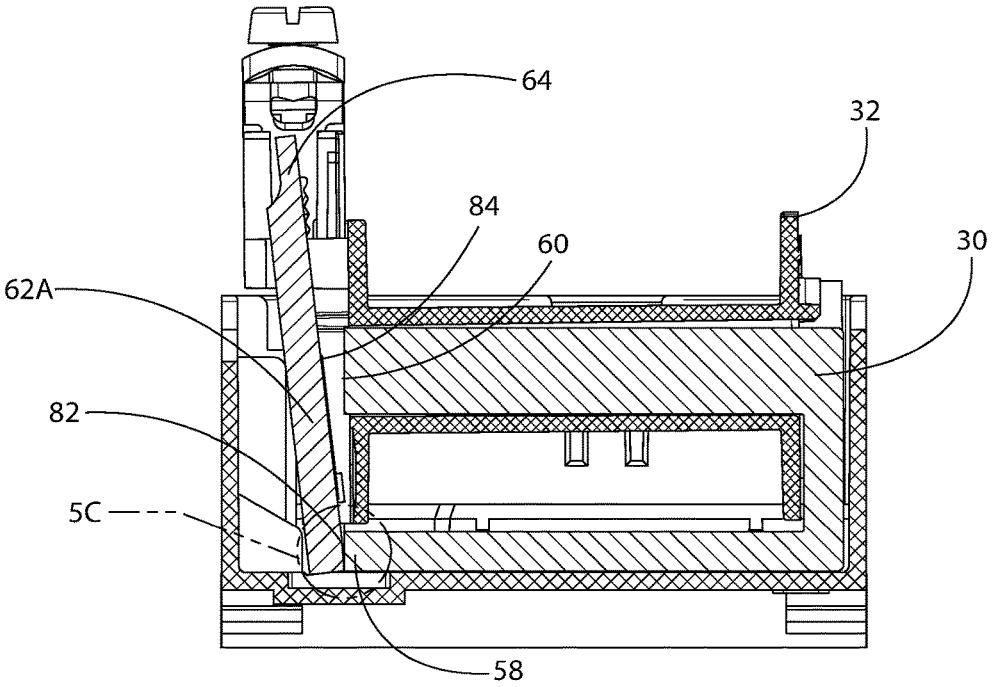
FIG. 5A is a sectional side view of the contactor of FIG. 1 showing the armature of FIG. 4A-4D with a radius embodiment of the pole face in its location in the contactor oriented in the de-energized state.
Figure 5B:
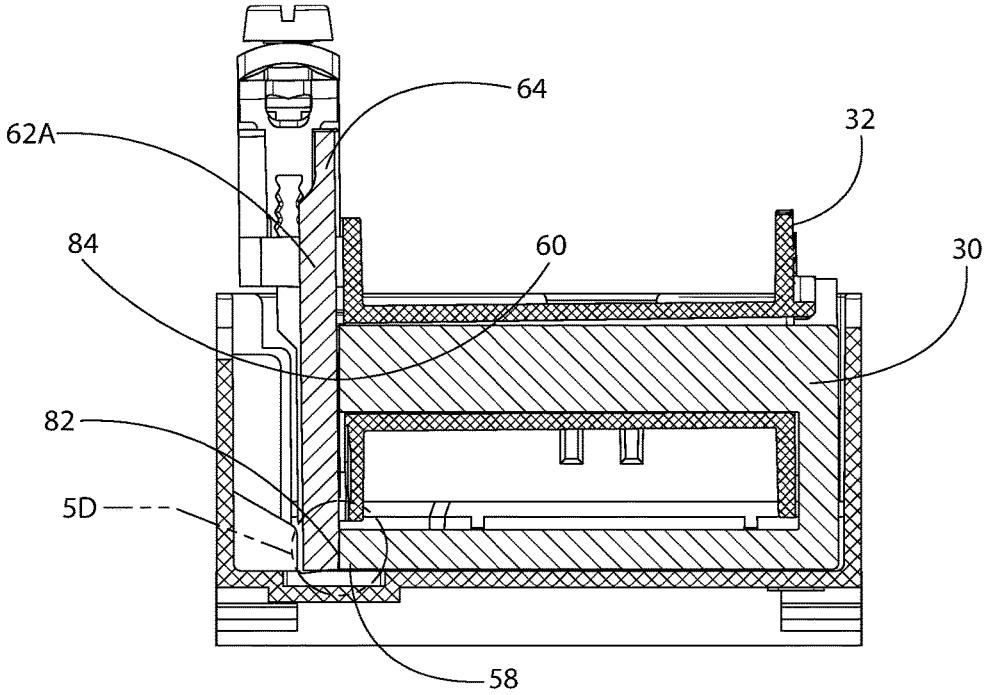
FIG. 5B is a sectional side view of the contactor of FIG. 1 showing the armature of FIG. 4A-4D with a radius embodiment of the pole face in its location in the contactor oriented in the energized state.
Figure 5C:
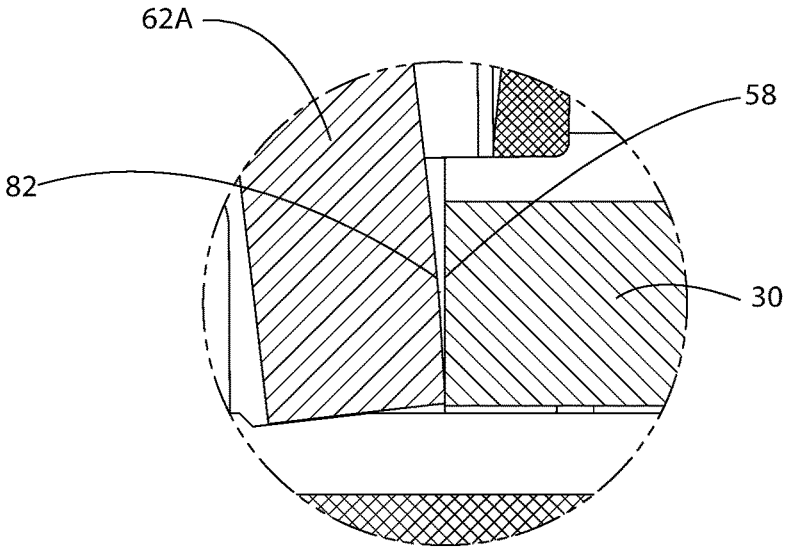
FIG. 5C is a detail of the sectional side view of FIG. 6A showing a radius embodiment of the pole face of the armature of FIG. 4A-4D in the de-energized state.
Figure 5D:
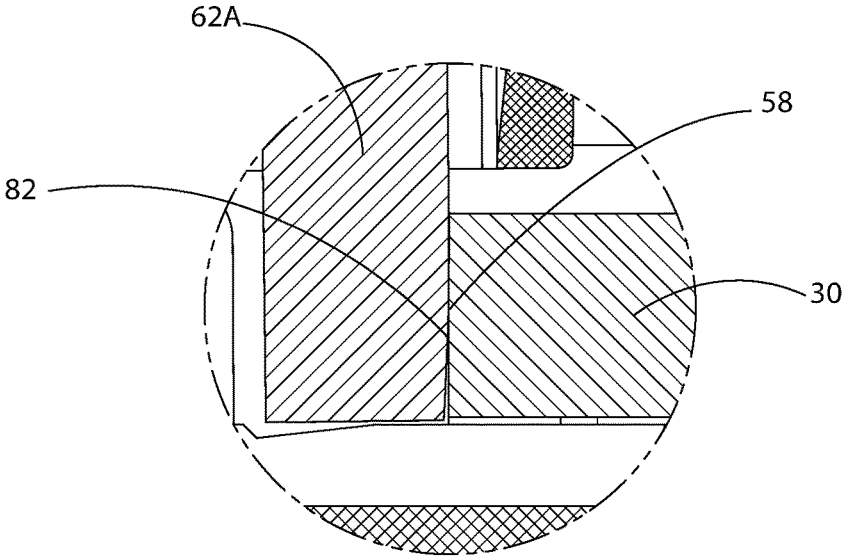
FIG. 5D is a detail of the sectional side view of FIG. 6B showing a radius embodiment of the pole face of the armature of FIG. 4A-4D in the energized state.
Figure 6A:
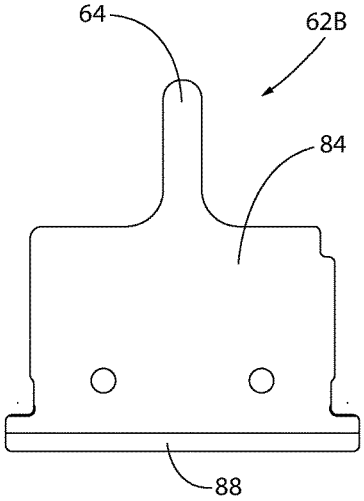
FIG. 6A is a front view of an armature with an involute embodiment of the pole face.
Figure 6B:
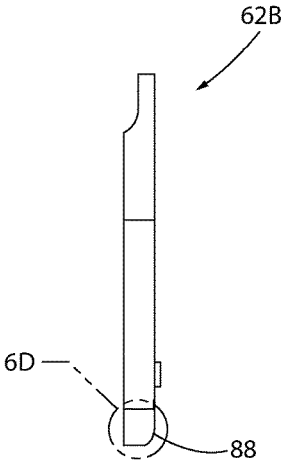
FIG. 6B is a side view of an armature with an involute embodiment of the pole face.
Figure 6C:
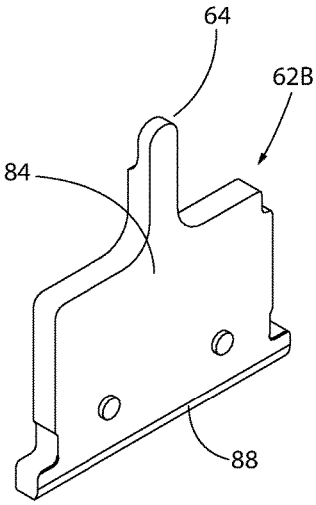
FIG. 6C is a perspective view of an armature with an involute embodiment of the pole face.
Figure 6D:
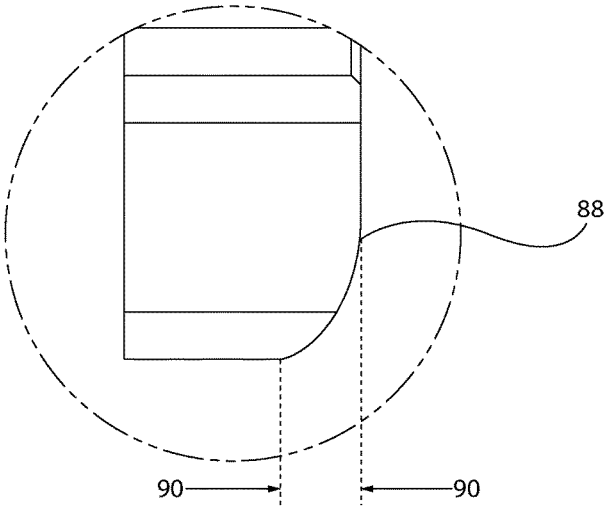
FIG. 6D is a detail view of the pole face of an armature with an involute embodiment of the pole face.
Figure 7A:
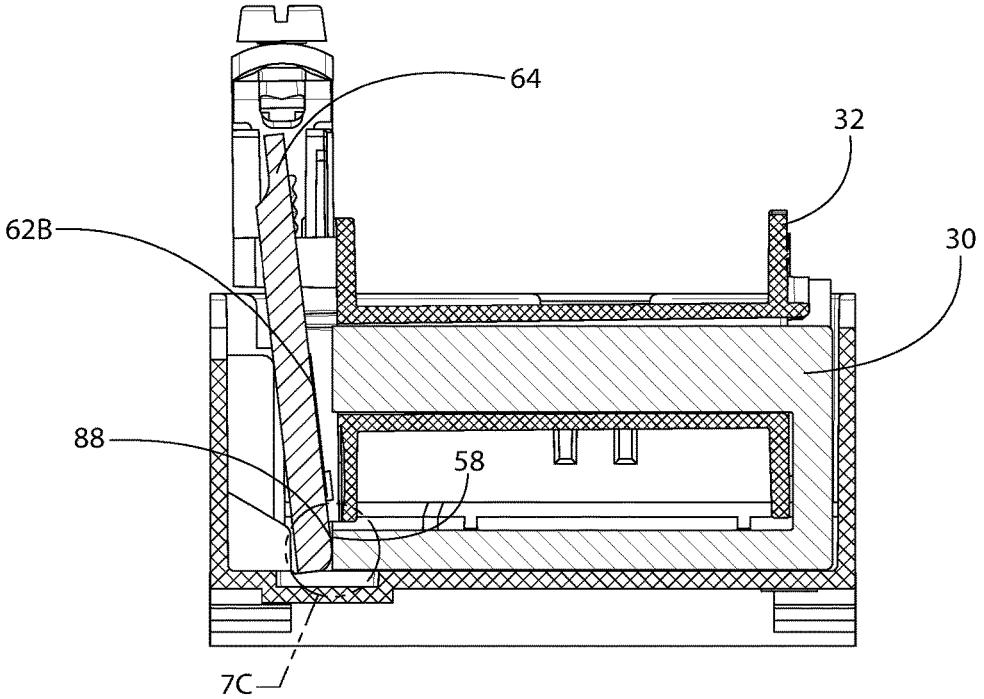
FIG. 7A is a sectional side view of the contactor of FIG. 1 showing the armature of FIG. 6A-6D with an involute embodiment of the pole face in its location in the contactor oriented in the de-energized state.
Figure 7B:
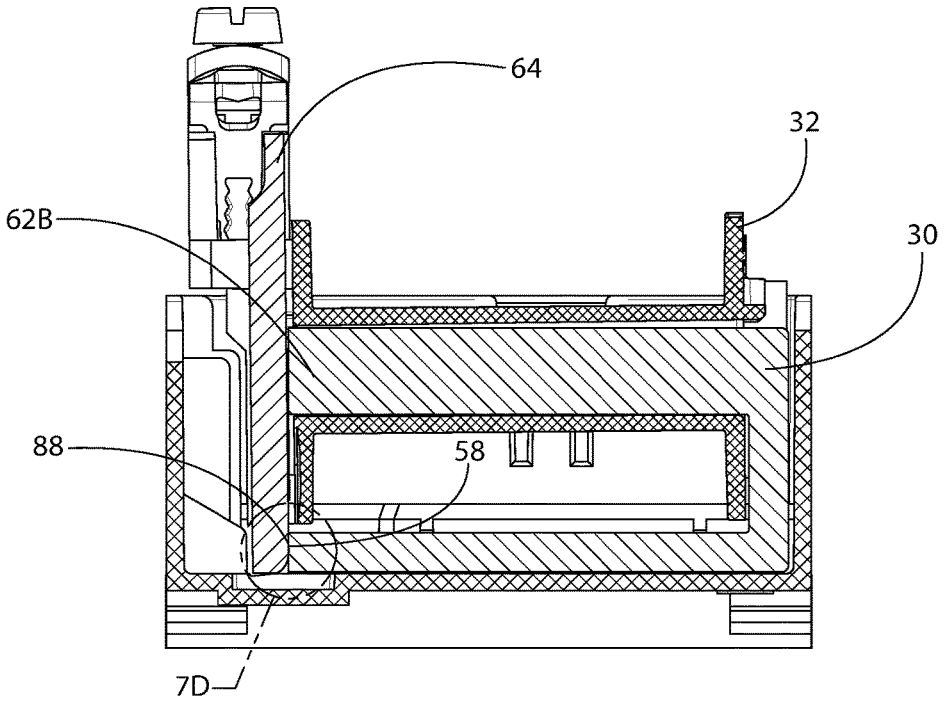
FIG. 7B is a sectional side view of the contactor of FIG. 1 showing the armature of FIG. 6A-6D with an involute embodiment of the pole face in its location in the contactor oriented in the energized state.
Figure 7C:
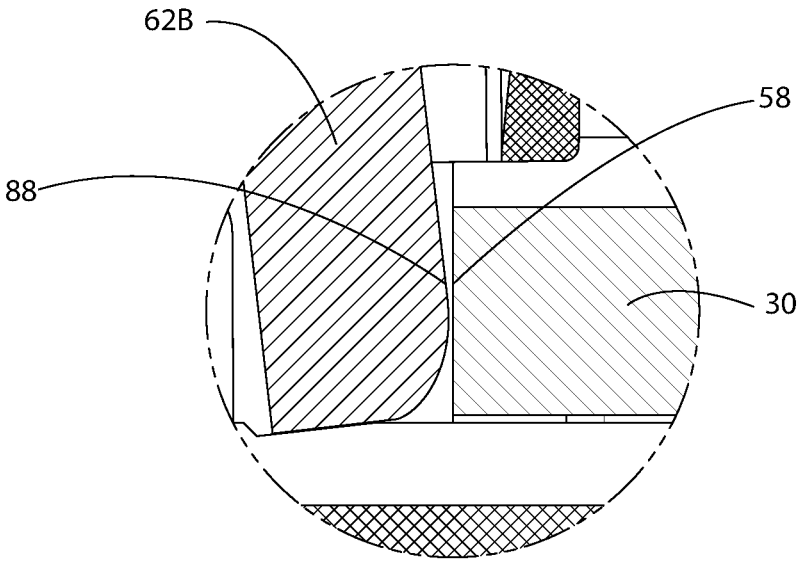
FIG. 7C is a detail of the sectional side view of FIG. 7A showing an involute pole face of the armature of FIG. 6A-6D in the de-energized state.
Figure 7D:
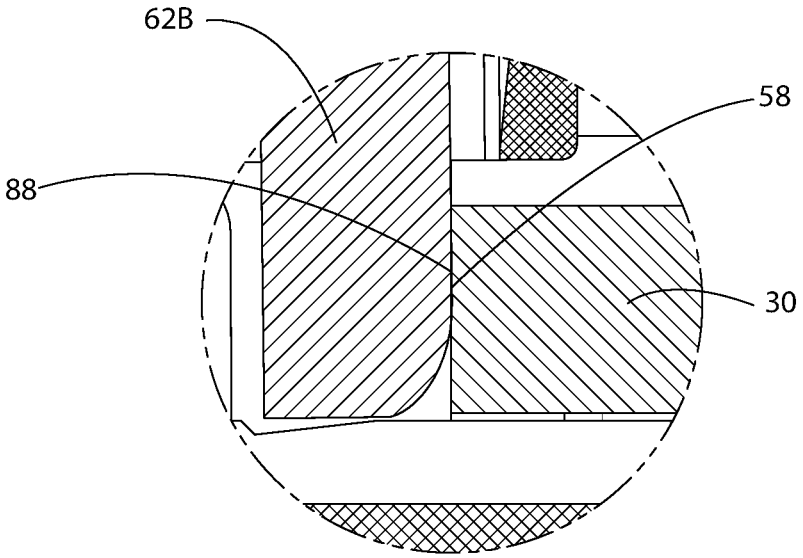
FIG. 7D is a detail of the sectional side view of FIG. 7A showing an involute pole face of the armature of FIG. 6A-6D in the energized state.

Given the interest in increasing the drop-out voltage in order to increase the speed at which a controlled circuit is de-energized in order to improve safety while simultaneously decreasing the pull-in voltage resulting in a longer service life for circuit interrupting devices, FIG. 4A through FIG. 4D depict various views of an embodiment of the invention in which, armature 62A has a radius pole face 82. Adding a radius to the pole face 82 has the effect of reducing the volume of air at the point of engagement between the radius pole face 82 and the lower stator core face 58 as illustrated in FIG. 5A with additional detail in FIG. 5C. Reducing the volume of air in the open or de-energized state causes an increase in the magnetic flux and associated magnetic force resulting in a reduced pull-in voltage when stator coil 32 is energized. In the closed or energized state, the effect of the radius pole face 82 is to increase the volume of air at the joint between the radius pole face 82 and the lower stator core face 58 as illustrated in FIG. 5B with additional detail in FIG. 5D. Therefore the magnetic flux and associated magnetic force is reduced which results in a higher dropout voltage with the additional benefit that the introduction of radius pole face 82 with its associated rolling movement having a shifting center point changes the lever arm of the armature pole face 82 resulting in decreased closing force which in turn increases the service life of circuit interrupting device 10. A similar result can be achieved by adding a radius to the lower stator core face 58, or in a combination with radius pole face 82 wherein both surfaces have a radius.

Various views of an alternate embodiment are depicted in FIG. 6A-6D. In this embodiment armature 62B has an involute pole face 88 as detailed in FIG. 6D. The involute pole face 88 provides improvement in an increased drop-out voltage, decreased pull-in voltage, and further decreased closing force over that of the radius pole face 82. As in the case of the radius pole face 82, improved results can be achieved by adding an involute curve to the lower stator core face 58, or in a combination with involute pole face 88 wherein both surfaces have an involute curve. In other embodiments various curved surfaces may be modeled and developed by the iteration of numerous planar surfaces in an arrangement that approximates a curved surface providing similar benefits as described.

While only certain features of the invention have been illustrated and described herein, many modifications and changes will occur to those skilled in the art. It is, therefore, to be understood that the appended claims are intended to cover all such modifications and changes as fall within the true spirit of the invention.

We claim:

1. An electromechanical switching device, comprising:
a first housing;
a second housing adjacent and coupled to the first housing;
at least three electrical terminals adapted to receive electrical conductors connected to a source of electrical line current, and at least three electrical terminals adapted to receive electrical conductors connected to an electrical load, the terminals located within the first housing;
an electromagnetic core having a core surface;
an armature having a pole face that contacts the core;
the electromagnetic core and armature located in the second housing;
wherein at least one of the core surface and the pole face is curved to provide a line of contact that moves in a rolling motion having a shifting center point with respect to the core under the influence of the flux between open and closed positions.

2. The device of claim 1, wherein the armature pole face has a generally circular curvature.

3. The device of claim 1, wherein the armature pole face has an involute curvature.

4. The device of claim 1, wherein the core surface has a generally circular curvature.

5. The device of claim 1, wherein the core surface has an involute curvature.

6. The device of claim 1, wherein both the armature pole face and the core surface have curved surfaces.

7. The device of claim 6, wherein the curved surface of both the armature pole face and the core surface have a generally circular curvature.

8. The device of claim 6, wherein the curved surface of both the armature pole face and the core surface have an involute curvature.

9. The device of claim 6, wherein the curved surface of the armature pole face is generally circular and the curved surface of the core surface is an involute curvature.

10. The device of claim 6, wherein the curved surface of the armature pole face is an involute curvature and the curved surface of the core surface is generally circular.

11. The device of claim 1, wherein the pole face is in operative engagement with at least a portion of the core.

12. The device of claim 1, wherein the curve of at least one of the core surface and the pole face reduces the pull-in voltage in the open position.

13. The device of claim 1, wherein the curve of at least one of the core surface and the pole face increases the drop out voltage in the closed position.

14. An electromechanical switching device, comprising:
A first housing,
at least three electrical terminals adapted to receive electrical conductors connected to a source of electrical line current, and at least three electrical terminals adapted to receive electrical conductors connected to an electrical load, the terminals located within the first housing,
an electromagnetic core having a core surface; and
an armature having a pole face that contacts the core,
a second housing adjacent and coupled to the first housing, forming a cavity sized for receiving the armature in free supporting relation to the core, wherein eccentric movement of the armature is allowed within the second housing against the core face of the electromagnetic core.

15. The device of claim 14 further comprising the curvature of at least one of the core surface and the pole face for providing the eccentric movement of the armature.

16. A method of controlling magnetic flux in an electromagnetic switching device, the electromagnetic switching device comprising a first housing, a second housing adjacent and coupled to the first housing, at least three electrical terminals adapted to receive electrical conductors connected to a source of electrical line current, and at least three electrical terminals adapted to receive electrical conductors connected to an electrical load, the terminals located within the first housing, an electromagnetic core and an armature located in the second housing, the method comprising:
providing an electromagnetic core having a core surface;

providing an armature having a pole face;

generating a rolling line of contact between a curved surface on at least one of the core surface and the pole face, the rolling motion having a shifting center point with respect to the core under the influence of the flux between a first or open state and a second or closed state;

defining a first volume between the core surface and the pole face in the first state such that the magnetic flux is increased upon application of a voltage to the electromagnetic core;

defining a second volume between the core surface and the pole face in the second state such that the magnetic flux is decreased upon the removal of a voltage to the electromagnetic core.

* * * * *